United States Patent [19]

Jackson et al.

[11] Patent Number: 4,956,144

[45] Date of Patent: Sep. 11, 1990

[54] HAFNIUM CONTAINING NB-TI-AL HIGH TEMPERATURE ALLOY

[75] Inventors: Melvin R. Jackson, Schenectady; Shyh-Chin Huang, Latham, both of N.Y.

[73] Assignee: General Electric Company, Schenectady, N.Y.

[21] Appl. No.: 288,394

[22] Filed: Dec. 22, 1988

[51] Int. Cl.[5] ..... C22C 30/00; C22C 27/02

[52] U.S. Cl. ..... 420/580; 420/426

[58] Field of Search ..... 420/580, 426

[56] References Cited

U.S. PATENT DOCUMENTS 3,753,699 8/1973 Anderson, Jr. et al. ..... 420/426

OTHER PUBLICATIONS

A. M. Samarin, ed; *Alloys of Niobium* translated version, pp. 245–247, 1965.

*Primary Examiner*—L. Dewayne Rutledge
*Assistant Examiner*—Margery S. Phipps
*Attorney, Agent, or Firm*—Paul E. Rochford; James C. Davis, Jr.; James Magee, Jr.

[57] ABSTRACT

An alloy is provided which has good operating strength and ductility at temperatures of 2000° to 2500° F. and density of between 6.5 and 7.0 g/cm$^3$. The alloy contains niobium titanium hafnium and aluminum in concentrations as set forth below:

| Ingredient | Concentration in Atom % From | To |
|---|---|---|
| Niobium | balance essentially | |
| Titanium | 32 | 45 |
| Hafnium | 8 | 15 |
| Aluminum | 3 | 18 |

7 Claims, 2 Drawing Sheets

HAFNIUM CONTAINING NB-TI-AL HIGH TEMPERATURE ALLOY

CROSS REFERENCE TO RELATED APPLICATIONS

The subject application relates to applications' Ser. Nos. 280,085, 279,639, and 279,640, filed Dec. 5, 1988; Ser. No. 07/288,667, filed Dec. 22, 1988; and Ser. No. 290,399, filed Dec. 29, 1988. The text of the related application is incorporated herein by reference.

BACKGROUND OF THE INVENTION

The present invention relates generally to alloys and to shaped articles formed for structural use at high temperatures. More particularly, it relates to an alloy having a niobium titanium base and which contains a hafnium additive. By a niobium titanium base is meant that the principal ingredients of the alloy are niobium and titanium.

There are a number of uses for metals which have high strength at high temperature. One particular attribute of the present invention is that it has, in addition to high strength at high temperature, a relatively low density of the order of 6.5 to 7.0 grams per cubic centimeter (g/cc).

In the field of high temperature alloys and particularly alloys displaying high strength at high temperature, there are a number of concerns which determine the field applications which can be made of the alloys. One such concern is the compatibility of an alloy in relation to the environment in which it must be used. Where the environment is the atmosphere, this concern amounts to a concern with the oxidation or resistance to oxidation of the alloy.

Another such concern is the density of the alloy. One of the groups of alloys which is in common use in high temperature applications is the group of iron-base, nickel-base, and cobalt-base superalloys. The term "base", as used herein, indicates the primary ingredient of the alloy is iron, nickel, or cobalt, respectively. These superalloys have relatively high densities of the order of 8 to 9 g/cc. Efforts have been made to provide alloys having high strength at high temperature but having significantly lower density.

It has been observed that the mature metal candidates for use in this field can be grouped and such a grouping is graphically illustrated in FIG. 1. Referring now to FIG. 1, the ordinate of the plot shown there is the density of the alloy and the abscissa is the temperature range, including the maximum temperature at which the alloy provides useful structural properties for aircraft engine applications. The prior art alloys in this plot are discussed in descending order of density and use temperatures.

With reference to FIG. 1, the materials of highest density and highest use temperatures are those enclosed within an envelope marked as Nb-base and appearing in the upper right hand corner of the figure. Densities range from about 8.7 to about 9.7 grams per cubic centimeter and use temperatures range from less than 2200° F. to about 2600° F.

Referring again to FIG. 1, the group of prior art iron, nickel, and cobalt based superalloys are seen to have the next highest density and also a range of temperatures at which they can be used extending from about 500° C. to about 1200° C.

A next lower density group of prior art alloys are the titanium-base alloys. As is evident from the figure, these alloys have a significantly lower density than the superalloys but also have a significantly lower set of use temperatures ranging from about 200° F. to about 900° F.

The last and lowest density group of prior art alloys are the aluminum-base alloys. As is evident from the graph these alloys generally have significantly lower density. They also have relatively lower temperature range in which they can be used, because of their low melting points.

A novel additional set of alloys is illustrated in the figure as having higher densities than those of the titanium-base alloys, but much lower densities than those of the superalloys and specifically in the range of 6.7 to 7.0. These alloys have useful temperature ranges potentially extending beyond the superalloy temperature range of up to about 2200° F. and extending in fact to over 2500° F. These ranges of temperature and density include those for the alloys such as are provided by the present invention and which are formed with a niobium titanium base.

BRIEF STATEMENT OF THE INVENTION

It is, accordingly, one object of the present invention to provide an alloy system which has substantial strength at high temperature relative to its weight.

Another object is to reduce the weight of the elements presently used in higher temperature applications.

Another object is to provide an alloy which can be employed where high strength is needed at high temperatures.

Other objects will be in part apparent and in part pointed out in the description which follows.

In one of its broader aspects, objects of this invention can be achieved by providing an alloy having ingredients and ingredient concentrations within the following ranges:

| Ingredient | Concentration in Atom % From | To |
|---|---|---|
| Niobium | balance essentially | |
| Titanium | 32 | 45 |
| Hafnium | 8 | 15 |
| Aluminum | 3 | 18 |

As used herein, the phrase "balance essentially" is used to include, in addition to niobium in the balance of the alloy, small amounts of impurities and incidental elements, which in character and amount do not adversely affect, and which may benefit, the advantageous aspects of the alloy.

BRIEF DESCRIPTION OF THE DRAWINGS

The description of the invention which follows will be understood with greater clarity if reference is made to the accompanying drawings in which.

DETAILED DESCRIPTION OF THE INVENTION

Figure 1:
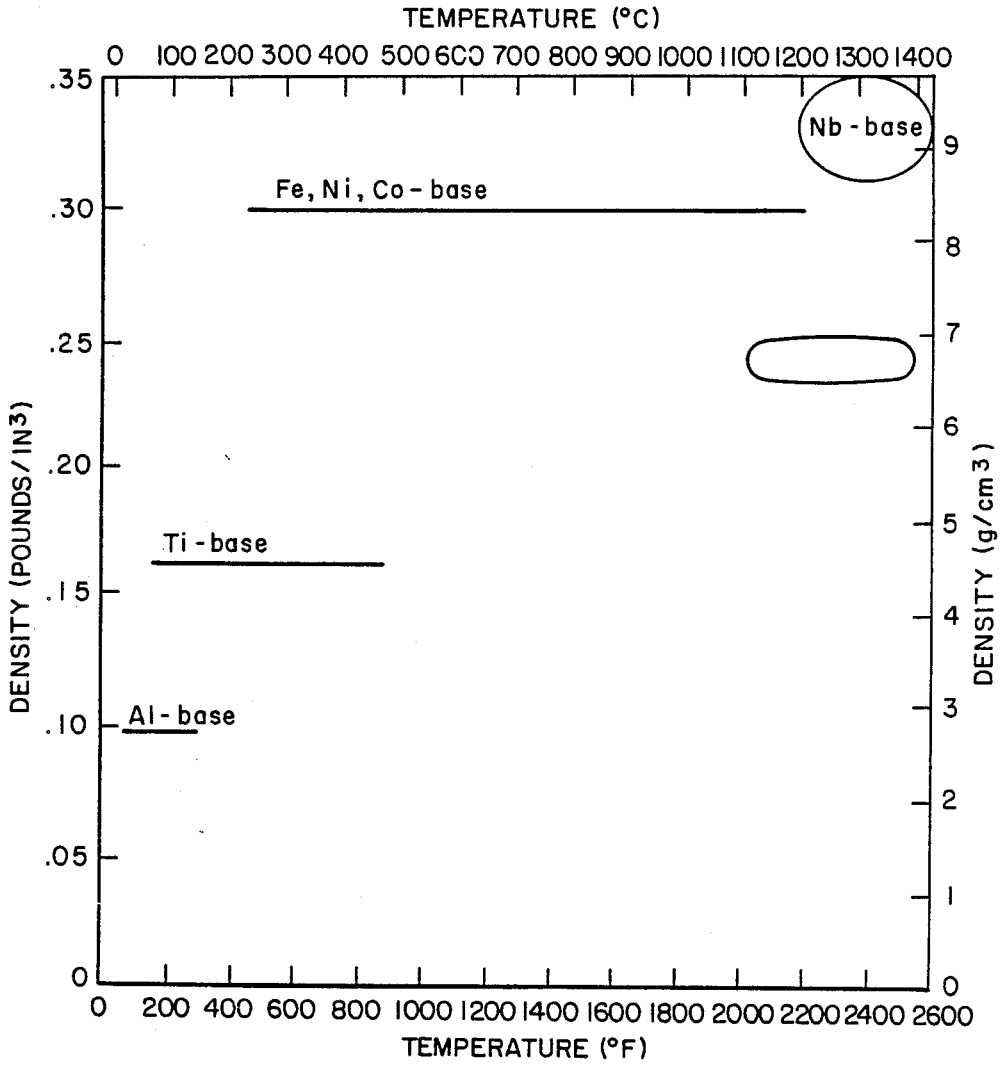
FIG. 1 is a graph in which density of an alloy is plotted against the temperature of use, the centigrade temperature being shown on a lower scale and the Fahrenheit scale on the upper scale.

It is known that intermetallic compounds, that is, metal compositions in which the ingredients are at concentration ratios which are very close to stoichiometric ratios, have many interesting and potentially valuable properties. However, many of these intermetallic compounds are brittle at lower temperatures or even at higher temperatures and, for this reason, have not been used industrially. It is valuable to have alloy compositions which are not dependent on the intermetallic ratios of ingredients and which have good ductility at elevated temperatures and also at moderate and lower temperatures. What is even more valuable is an alloy composition, ingredients of which can be varied over a range and which have both high strength at higher temperatures and also good ductility over a range of temperatures. The compositions of the present invention meet these criteria. The temperature range of which they are useful extends from less than 2000° F. to over 2500° F. This useful temperature range is illustrated in FIG. 1. Also in FIG. 1, the density range of the compositions of the present invention extending from about 6.5 to about 7.0 is illustrated in the Figure.

EXAMPLES 1-3:

A number of alloy compositions were prepared as is set forth in Table I (in atomic percent) immediately below.

TABLE I

| Example | Ingredient and Concentration | | | |
|---|---|---|---|---|
| | Nb | Ti | Al | Hf |
| 1 | 41 | 41 | 6 | 12 |
| 2 | 38 | 38 | 12 | 12 |
| 3 | 35 | 35 | 18 | 12 |

Each of the melts which was prepared was formed into a ribbon by a rapid solidification process. The rapid solidification involved causing the metal to undergo a very large cooling rate. There are several methods by which the requisite large cooling rates may be obtained. One such process is a melt spinning cooling. A preferred laboratory method for obtaining the requisite cooling rates is the chill-block melt spinning process. Briefly and typically, in the chill-block melt spinning process, molten metal is delivered from a crucible through a nozzle, usually under the pressure of an inert gas, to form a free standing stream of liquid metal or a column of liquid metal in contact with the nozzle which is then impinged onto or otherwise placed in contact with the rapidly moving surface of a chill-block, i.e. a cooling substrate, made of material such as copper. The material to be melted can be delivered to the crucible as separate solids of the elements required and melted therein by means such as an induction coil placed around the crucible. Alternatively, the alloys such as the alloys described above, for example 1, 2, and 3, can be introduced into the crucible and melted therein.

When the liquid melt contacts the cold chill-block, it cools rapidly, from about $10^{3}$° C. per second to $10^{7}$° C. per second and solidifies in the form of a relatively continuous length of a thin ribbon whose width is considerably larger than its thickness. A more detailed teaching of the chill-block melt spinning process may be found, for example, in U.S. Pat. Nos. 2,825,108; 4,221,257; and 4,282,921, the texts of which patents are incorporated herein by reference.

The ribbons prepared in this fashion were consolidated in a conventional fashion by HIPing. Conventional HIPing is a process involving simultaneous application of heat and pressure to cause the ribbon to bond into a solid without melting.

Conventional tensile test bars were prepared from the consolidated ribbon sample and conventional tensile tests were run at room temperature, 760° C., 980° C., and 1200° C., for each of the three samples of alloy which had been prepared. The results of these tests are presented in Table II below.

TABLE II

| Example | Test Temp. | Yield Strength | Ultimate Strength | Reduction in Area |
|---|---|---|---|---|
| 1 | 23° C. | 114 ksi | 115 ksi | 25% |
| | 760° C. | 63 | 64 | 85 |
| | 980° C. | 30 | 30 | 84 |
| | 1200° C. | — | — | — |
| 2 | 23° C. | 128 ksi | 128 ksi | 15% |
| | 760° C. | 74 | 75 | 83 |
| | 980° C. | 19 | 20 | 91 |
| | 1200° C. | 10 | 11 | 91 |
| 3 | 23° C. | * | 101 ksi | 0% |
| | 760° C. | 100 ksi | 104 | 51 |
| | 980° C. | 21 | 21 | 93 |
| | 1200° C. | 9 | 10 | 93 |

*sample failed elastically

From the data presented in Table II, it is evident that the alloys have substantial room temperature strength. The yield strength measurements made at 760° C. indicate that the yield strength increases with increasing aluminum concentration. The measurements at the higher temperatures of 980° C. and 1200° C. indicate a reversal of the effect of higher aluminum concentration. In the 980° C. test, the highest yield strength value was found for the sample with 6 atomic % aluminum and the lower value was found at the 12 and 18 atomic % aluminum concentration. Similarly, at 1200° C., the lower values were obtained at the 12 and 18 atomic %, aluminum concentrations. The tensile test measurement at 1200° C. for the alloy containing 6 atomic % aluminum is thought to be an erratic and unreliable result, and is not reported.

Figure 2:
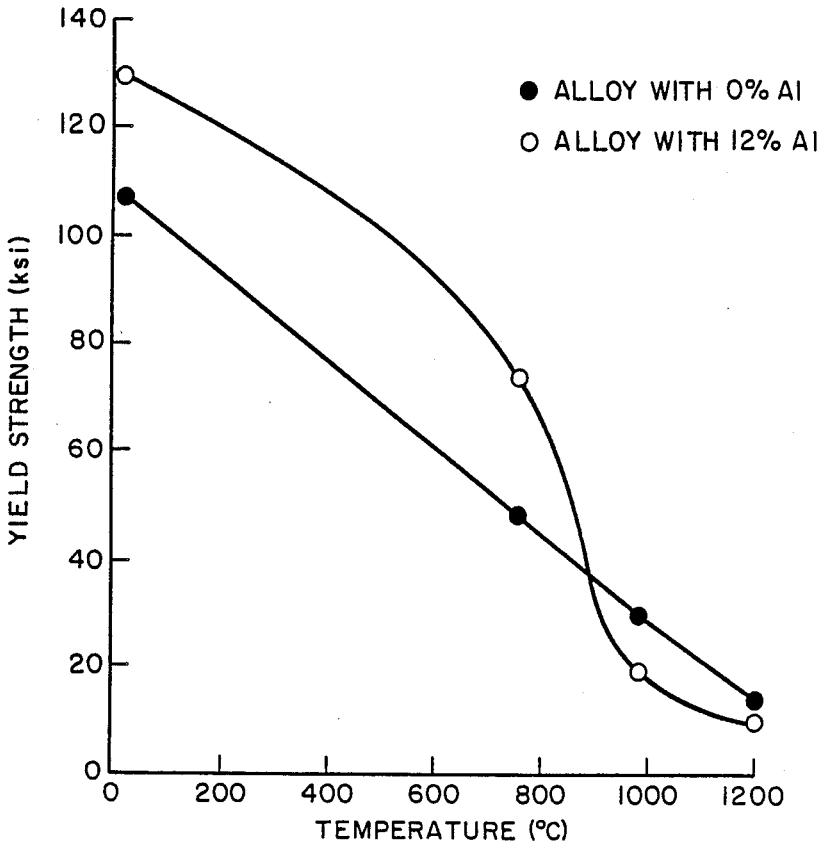
FIG. 2 is a graph in which temperature in degrees centigrade is plotted against yield strength in ksi for two alloys—one containing aluminum, and the other free of aluminum.

Tensile strength results are compared in FIG. 2 for an alloy containing no aluminum and for an alloy containing 12 atomic percent aluminum. The alloy containing only niobium hafnium and titanium is described in copending application Ser. No. 07/288,667, filed Dec. 22, 1988. The influence of aluminum additions on alloy properties is illustrated graphically. At lower temperatures the addition of aluminum increases strength significantly. At higher temperatures the strength of the aluminum containing alloy falls below the line formed along data points taken for an alloy free of aluminum.

Ductility at elevated temperature is good for all three alloys. However, room temperature ductility is very dependent on aluminum content, with ductility decreasing as aluminum concentration increases.

The alloys of this invention may advantageously be formed into sheets. The sheets have outstanding properties of strength at high temperatures and are suitable for use in structures requiring high strength in sheet form at high temperatures.

Samples of the alloys of the three examples were subjected to oxidation testing. For this purpose the alloys were subjected to heating in air at temperatures of 800° C., 1000° C., and 1200° C. For comparison, two additional samples were tested simultaneously. One was a commercial alloy known under the designation Cb-752. The other was an aluminum free alloy of copending application Ser. No. 07/288,667, filed Dec. 22, 1988.

The Cb-752 alloy sample was 0.076 cm thick and the other alloys were thinner and had thickness dimensions between 0.064 and 0.074 cm.

The tests were conducted and data from the tests were collected. The data is set forth in Table III immediately below.

TABLE III

| | Weight Gain in Oxidative (Air) Exposure | | | | |
|---|---|---|---|---|---|
| | Commercial Alloy Cb-752 | NbTiHf Alloy OAl | Example 1 | Example 2 | Example 3 |
| 800° C. | 1 hour - 22.5 mg/cm | 16 hours - 8.4 mg/cm | 16 hours - 9.4 mg/cm | 16 hours - 7.3 mg/cm | 16 hours - 4.1 mg/cm |
| | | 35 hours - 12.4 mg/cm | 35 hours - 12.4 mg/cm | 35 hours - 11.2 mg/cm | 35 hours - 5.5 mg/cm |
| 1000° C. | 1 hour - sample consumed | 1 hour - 7.3 mg/cm | 1 hour - 8.9 mg/cm | 1 hour - 4.5 mg/cm | 1 hour - 4.1 mg/cm |
| | | 3 hours - 12.0 mg/cm | 3 hours - 12.0 mg/cm | 3 hours - 8.0 mg/cm | 3 hours - 6.9 mg/cm |
| | | 9 hours - severe spalling | 9 hours - severe spalling | 9 hours - 8.8 mg/cm | 9 hours - 10.6 mg/cm |
| 1200° C. | 1 hour - sample consumed | 1 hour - 37.1 mg/cm | 1 hour - 26.7 mg/cm | 1 hour - 11.8 mg/cm | 1 hour - 11.8 mg/cm |
| | | 2 hours - 66.7 mg/cm | 2 hours - 44.3 mg/cm | 2 hours - 23.9 mg/cm | 2 hours - 19.4 mg/cm |

What was observed was that the sample of commercial alloy Cb-752 oxidized very quickly and was totally oxidized and consumed in one hour at the 1200° C. temperature and at the 1000° C. temperature. The commercial alloy was severely attacked at the 800° C. heating temperature.

The alloys of the examples displayed far superior resistance to oxidation as compared to the commercial alloy Cb-752 at all three test temperatures as is evident from the data included in Table III above.

The favorable influence of aluminum on the alloy of the examples is evidenced by comparison of the example alloys to the alloy of copending application Ser. No. 07/288,667, filed Dec. 22,1988.

At the 6 atomic percent aluminum level a clear beneficial effect is notes at 1200° C. and little effect is noted at 800° C. or at 1000° C. However, from the data in Table III, at the 12 and 18 atom percent levels, clear beneficial oxidation resistance superiority over the alloy free of aluminum is noted at all three temperatures.

The alloys of this invention may be prepared by conventional ingot metallurgy. The rapid solidification route is also an effective way of preparing the alloys but is not essential to practice of the present invention.

What is claimed and sought to be protected by Letters Patent of the U.S. is as follows:

1. An alloy consisting essentially of the following ingredients and ingredient concentrations in atomic percent:

| | Concentration in Atom % | |
|---|---|---|
| Ingredient | From | To |
| Niobium | balance essentially | |
| Titanium | 32 | 45 |
| Hafnium | 8 | 15 |
| Aluminum | 3 | 18 |

2. The alloy of claim 1, in which the titanium is between 35 and 42 percent.

3. The alloy of claim 1, in which the hafnium is between 8 and 12 percent.

4. The alloy of claim 1, in which the aluminum is between 5 and 14 percent.

5. The alloy of claim 1, in which the titanium is between 35 and 42 percent and the hafnium is between 8 and 12 percent.

6. The alloy of claim 1, in which the titanium is between 35 and 42 percent and the aluminum is between 5 and 14 percent.

7. The alloy of claim 1, in which the hafnium is between 8 and 12 percent and the aluminum is between 5 and 14 percent.

* * * * *